US007992642B2

(12) United States Patent
Gewily et al.

(10) Patent No.: US 7,992,642 B2
(45) Date of Patent: Aug. 9, 2011

(54) POLISHED BORE RECEPTACLE

(75) Inventors: Ahmed Amr Gewily, Nasr (EG); Anwar Assal, Sugar Land, TX (US); Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 482 days.

(21) Appl. No.: 12/126,071

(22) Filed: May 23, 2008

(65) Prior Publication Data

US 2008/0289813 A1 Nov. 27, 2008

Related U.S. Application Data

(60) Provisional application No. 60/939,634, filed on May 23, 2007.

(51) Int. Cl.
*E21B 33/00* (2006.01)

(52) U.S. Cl. ..... 166/334.4; 166/380; 166/179; 166/130; 166/242.7

(58) Field of Classification Search ..... 166/380, 166/179, 130, 106, 107
See application file for complete search history.

(56) References Cited

U.S. PATENT DOCUMENTS

| | | | | |
|---|---|---|---|---|
| 4,262,742 | A * | 4/1981 | James | 166/68 |
| 4,640,354 | A | 2/1987 | Boisson | |
| 4,844,159 | A | 7/1989 | Airey | |
| 5,010,958 | A | 4/1991 | Meek | |
| 5,033,551 | A * | 7/1991 | Grantom | 166/387 |
| 5,050,682 | A | 9/1991 | Huber | |
| 5,095,993 | A | 3/1992 | Huber | |
| 5,203,414 | A | 4/1993 | Hromas | |
| 5,366,010 | A * | 11/1994 | Zwart | 166/120 |
| 5,429,192 | A | 7/1995 | Huber | |
| 6,315,075 | B1 | 11/2001 | Nakajima | |
| 6,378,610 | B2 | 4/2002 | Rayssiguier | |
| 6,382,324 | B1 | 5/2002 | Anyan | |
| 6,405,804 | B1 | 6/2002 | Ohmer | |
| 6,419,021 | B1 | 7/2002 | George | |
| 6,419,024 | B1 | 7/2002 | George | |
| 6,497,288 | B2 | 12/2002 | George | |
| 6,588,542 | B2 | 7/2003 | Nakajima | |
| 6,629,568 | B2 | 10/2003 | Post | |
| 6,651,747 | B2 | 11/2003 | Chen | |
| 6,681,861 | B2 | 1/2004 | Davidson | |
| 6,712,149 | B2 | 3/2004 | Leismer | |
| 6,817,598 | B2 | 11/2004 | Parrott | |
| 6,920,936 | B2 | 7/2005 | Sheiretov | |
| 7,281,578 | B2 | 10/2007 | Nakajima et al. | |
| 7,281,588 | B2 | 10/2007 | Shampine | |
| 7,334,642 | B2 | 2/2008 | Doering | |
| 2006/0076146 | A1 | 4/2006 | Veneruso | |
| 2007/0056745 | A1 | 3/2007 | Contant | |
| 2007/0089886 | A1 | 4/2007 | Orban | |
| 2007/0199721 | A1 | 8/2007 | Givens | |
| 2008/0061510 | A1 | 3/2008 | Li | |
| 2008/0164037 | A1 | 7/2008 | Hammami | |

* cited by examiner

*Primary Examiner* — Daniel P Stephenson
*Assistant Examiner* — Yong-Suk Ro
(74) *Attorney, Agent, or Firm* — Rodney Warfford

(57) ABSTRACT

An integral polished bore assembly for use in a wellbore. The assembly includes a barrel having a polished bore; at least one no-go member positioned within the barrel; an elongated locator member having a sealing head and an end, the end extending out of the barrel; and a radial port formed through the barrel.

19 Claims, 5 Drawing Sheets

POLISHED BORE RECEPTACLE

RELATED APPLICATIONS

This application claims the benefit of U.S. Provisional Patent Application No. 60/939,634 filed May 23, 2007, incorporated herein by reference.

BACKGROUND

A variety of equipment and devices are used in downhole wellbore environments. In certain applications, tubing is coupled to a packer via a polished bore receptacle with a seal stack assembly disposed at the downhole end of the tubing.

For example, a packer may be disposed within a wellbore for the production of a desired fluid. A completion tail pipe assembly is typically positioned below the packer. The production fluid flows upwardly through packer into the tubing and then to a surface location or other collection point. The tubing may have substantial length and is subject to expansion and contraction while in the wellbore. Thus, it is desirable to have a coupling between the packer and the production tubing that accommodates this movement. Often, a polished bore receptacle is latched into an upper end of the packer, and an appropriate seal stacks assembly is stung into the polished bore receptacle (PBR) and attached to the polished bore receptacle (PBR) via shear screws to prevent leakage between the interior of the PBR and the production tubing. Conventionally, downhole deployment of the PBR and the tubing with associated seal stack required single trip downhole. After setting the packer, the conventional polished bore receptacle (PBR) with an appropriate seal stacks assembly has another function in order to spot the completion/packer inhibited fluids above the packer in the annular area between the casing inside diameter and the production tubing outside diameter all the way up to surface. This function is activated by applying upward pulling force that exceeds the shear value is required to separate the appropriate seal stacks assembly from the polished bore receptacle (PBR). Thus, the seal stacks assembly is completely stung out of the polished bore receptacle (PBR) to establish circulating path from the internal of the production tubing to the annular area between the casing inside diameter and the outside diameter of the production tubing (above the packer).

It is sometimes desired to de-complete the well or retrieve the packer. Conventionally, this may require five trips or two and one-half round trips. The first trip is pulling the tubing, and the seal stacks assembly (it is disconnected from the PBR), out of the wellbore to connect a PBR retrieving tool. The second trip is tripping into the wellbore with the retrieving tool. The third trip is tripping out of the wellbore with the retrieved PBR. The fourth trip is then running back in the wellbore with a packer retrieving tool. The fifth trip is pulling out of the wellbore with the retrieve packer. Thus, conventional de-completion may require at least five trips.

SUMMARY

One example of an integral polished bore assembly for use in a wellbore includes a barrel having a polished bore; a pair of opposing no-go members positioned within the barrel; an elongated locator member having a sealing head and an end, the sealing head position between the no-go members and the end extending out of the barrel; and at least one radial port formed through the barrel between the opposing no-go members.

An example of a wellbore system disclosed herein includes a tubular string, a packer, and an integral polished bore assembly interconnecting the tubular string and the packer, wherein the integral polished bore assembly facilitates removing the tubular string and integral polished bore assembly simultaneously from the wellbore.

One example of a method of using an integral polished bore assembly in a wellbore includes the steps of interconnecting a tubing string and a packer with an integral polished bore assembly; deploying the interconnected tubing string, integral polished bore assembly, and the packer in a wellbore; disconnecting the integral polished bore assembly from the packer; and retrieving the tubing and the integral polished bore assembly simultaneously from the wellbore.

DETAILED DESCRIPTION

Figure 1:
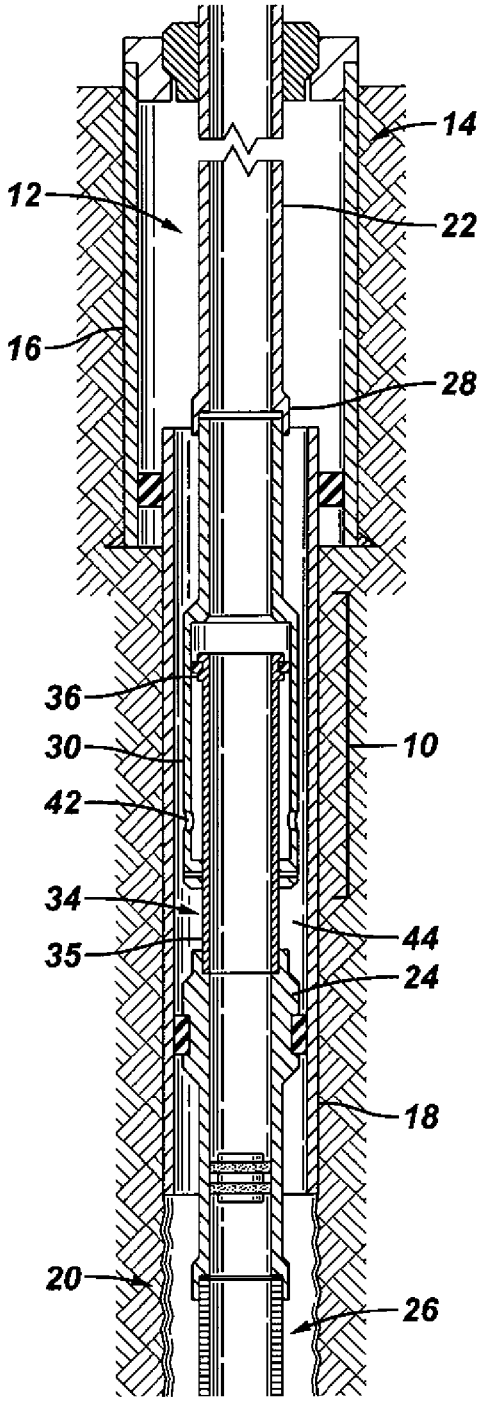
FIG. 1 is a well schematic illustrating an example of an integral polished bore receptacle assembly in a first operational position.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point. Likewise, the terms "tubular member," "casing," "liner," and "tubing" may be used interchangeably. In addition, any embodiment described herein for use with a casing may also be used with a liner or other tubular member. As used herein, the term "polished bore receptacle" or "PBR" includes without limitation a smooth, polished or honed bore formed on the inner surface of a tubular member, casing, or liner having a predetermined diameter for sealing or mating with a sealing mechanism. Additionally, "trip" is used herein to refer to a running into the wellbore (e.g., tripping-in) or pulling out of the wellbore (e.g., tripping-out) and "round trip" as the combination of tripping-in and tripping-out, without limitation to the initial trip direction, to complete an operation.

FIG. 1 is a well schematic illustrating an example of an integral PBR assembly of the present invention, generally denoted by the numeral 10, disposed in a well string 12 and positioned in a well 14. Well string 12 is described herein as a completion string. Well 14 is shown completed with a surface casing string 16, a liner 18, and an open hole section 20 defining the wellbore or borehole. String 12 includes a tubing 22, PBR assembly 10, packer 24, and a lower completion 26, such as but not limited to a sand screen, slotted liner, or the like. Packer 24 is commonly considered as part of completion 26.

Integral PBR assembly 10 is connected to tubing 22 on one side and with packer 24 on the other side. In the example illustrated herein, tubing 22 is connected to PBR assembly 10 by threading at joint 28. Other means and mechanisms for connection may be utilized. Although not shown herein, there may be subs and or other operational members, such as without limitation valves, compensation joints and the like connected between PBR assembly 10 and tubing 22.

Figure 1A:
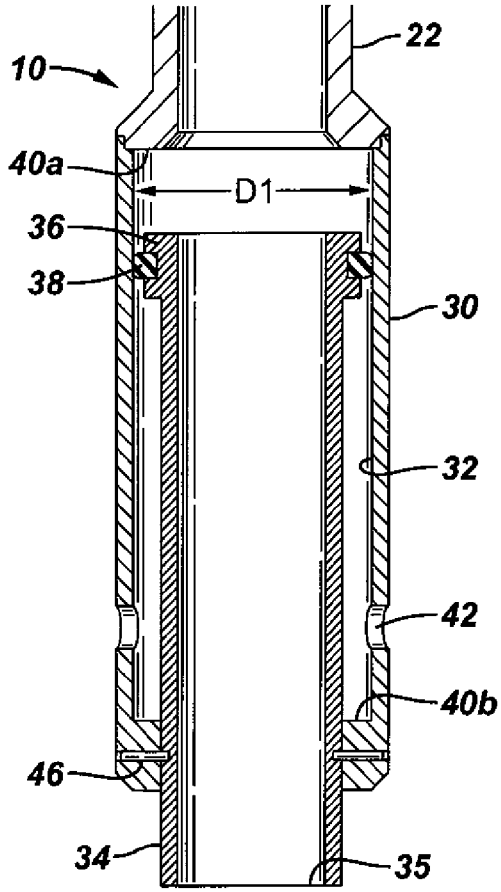
FIG. 1A is a conceptual view of an integral polished bore receptacle assembly of FIG. 1.

Refer now to FIG. 1A, with continuing reference to FIG. 1, wherein a conceptual view of PBR assembly 10 is shown in isolation. In the illustrated example, assembly 10 includes a barrel 30, a locator member 34, circulating ports 42, and a holding member or mechanism 46.

Barrel 30 defines the internal polished bore 32, having a diameter "D1." Locator member 34 is an elongated member having a sealing head 36, or shoulder, which is disposed within polished bore 32 of barrel 30. Head 36 may carry a seal 38 and is sized so as to hydraulically seal within polished bore 32. Head 36 is positioned between no-go shoulders 40*a* and 40*b* at opposing ends of barrel 30. No-go shoulders 40 define bores that have a diameter less than diameter D1 of barrel 30, thus restricting movement of head 36 between shoulders 40*a* and 40*b*. In the illustrated example locator 34 has an end 35 that extends out of the bottom of barrel 30 and is selectably connected with packer 24. The connection with packer 24 may be made in various manners including, without limitation, a landing latch whereby physical connection and disconnection may be achieved by rotation of tubing 22. In the illustrated example, end 35 is indicated as a landing latch for direct connection to packer 24. However, it is readily known and recognized that locator 34 may be indirectly connected to packer 24 through one or more intervening elements, including without limitation subs.

Ports 42 provide fluid communication between annulus 44 (FIG. 1) and the internal bore of assembly 10 and tubing 22 radially through barrel 30. Releasable holding element 46 selectively holds locator 34 in a secure position relative to barrel 30 until holding element 46 is disengaged. Holding element 46 is illustrated herein as shear screws or pins. However, it recognized that other releasable holding mechanisms such as without limitation shear pins, collets, and rupture discs may be utilized. After holding member 46 is released, locator 34 and head 36 may move axially and rotationally relative to barrel 30. The shear value of members 46 may be greater than the force necessary to activate packer 24.

FIGS. 1 and 1A illustrate assembly 10 in a first position that is also referred to as the run-in the hole (RIH) position. In the RIH position, radial fluid flow through port 42 is blocked and holding mechanism 46 is securing locator 34 in a constant position relative to barrel 30. In the present example, tubing 22, PBR assembly 10, and packer 24 are interconnected and run into wellbore 14 simultaneously.

Figure 2:
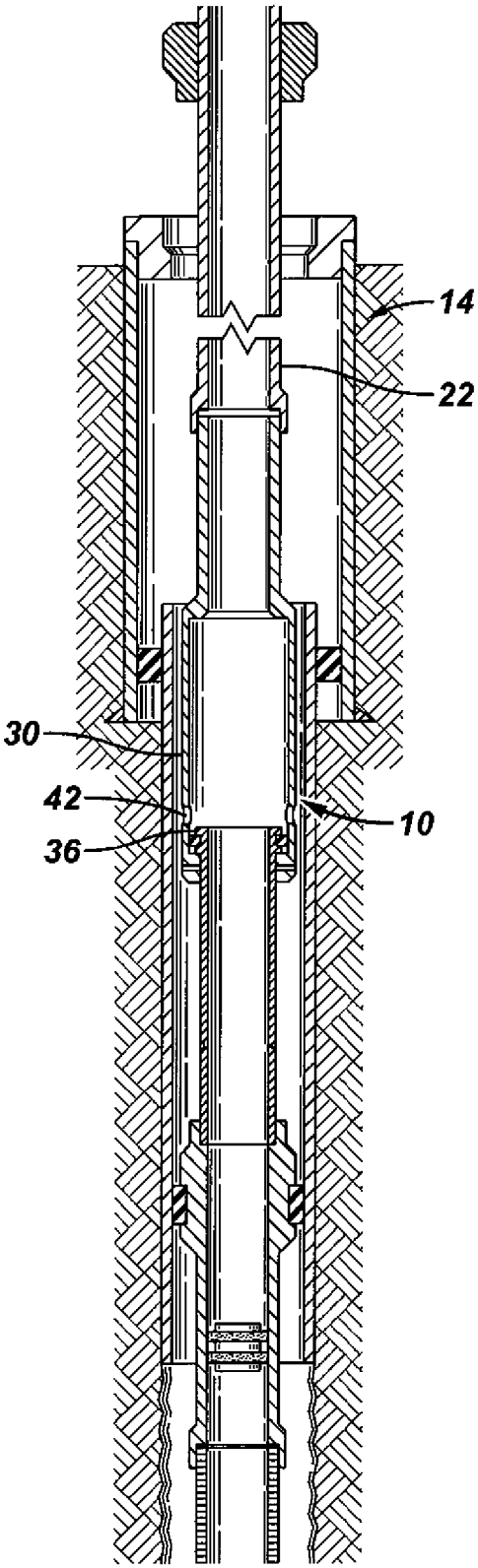
FIG. 2 is a well schematic illustrating an example of an integral polished bore receptacle assembly in a second operational position.
Figure 2A:
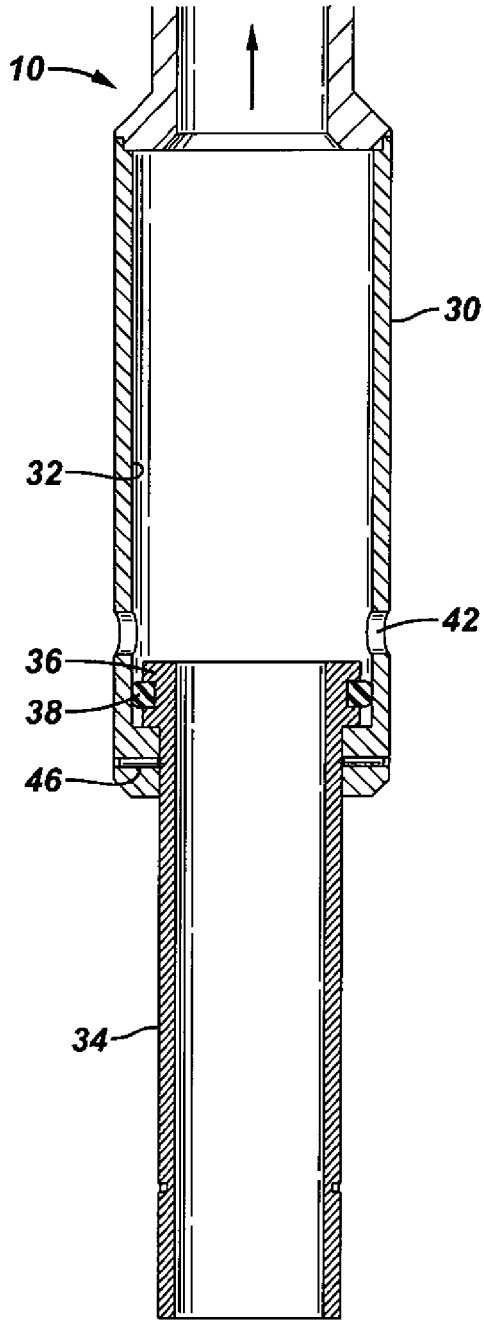
FIG. 2A is a conceptual view of an integral polished bore receptacle assembly of FIG. 2.

Refer now to FIGS. 2 and 2A, wherein assembly 10 is shown in a second position with ports 42 open to displace the well. Once packer 24 is positioned where desired in well 14, locator 34 may be released to open ports 42. In the illustrated example, tension is applied via tubing 22, in the direction shown by the arrow in FIG. 2A, shearing members 46. Once locator 34 and barrel 30 are released, axial movement of barrel 30 relative to locator head 36 uncovers port 42 for fluid communication. Locator 34 and barrel 30 are also released from a constant position relative to one another to allow for expansion and other axial movement that may occur. It is recognized that assembly 10 may be oriented in various manners and that the use of terms such as push, and pull, are utilized for purposes of description and are not limiting as to any required operation of assembly 10.

Figure 3:
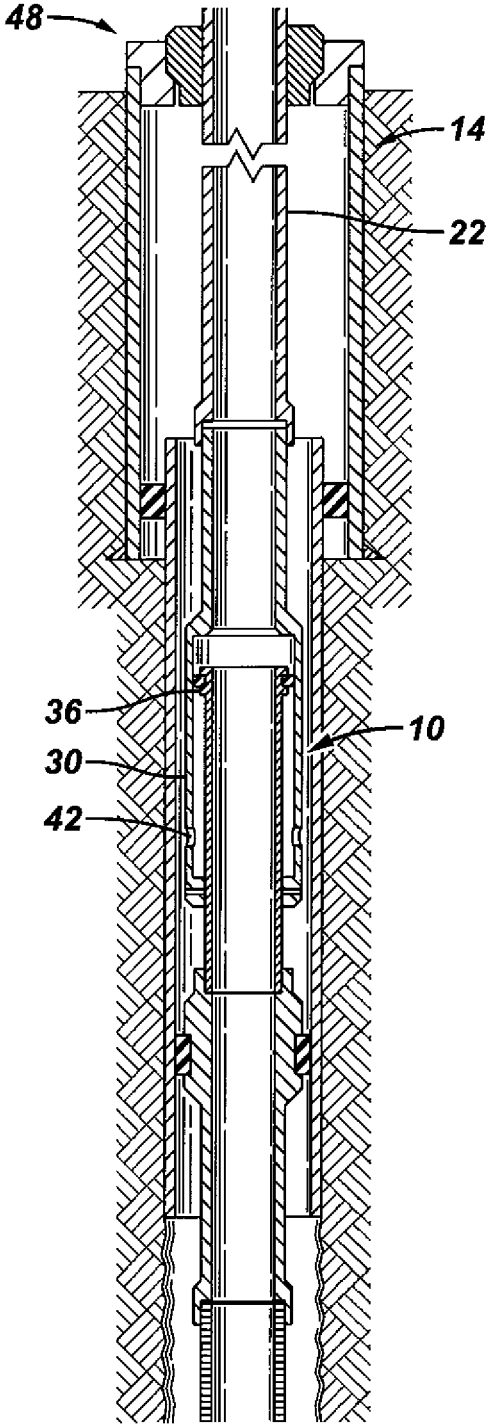
FIG. 3 is a well schematic illustrating an example of an integral polished bore receptacle assembly in a third operational position.
Figure 3A:
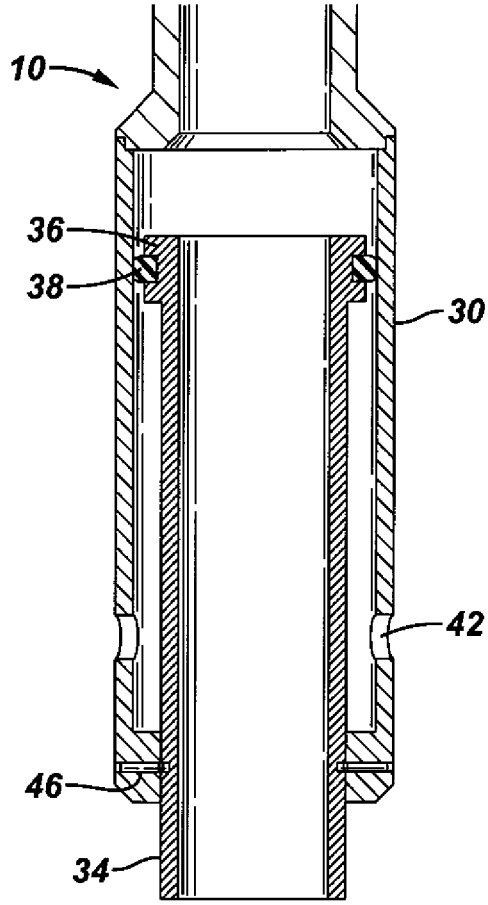
FIG. 3A is a conceptual view of an integral polished bore receptacle assembly of FIG. 3.

FIGS. 3 and 3A illustrate assembly 10 and well 14 in the production phase. In these illustrations, tubing 22 has been landed and is hanging in this example from wellhead 48 and packer 24 is set. Seal head 36 of locator 42 is position so that radial fluid flow is blocked through ports 42. Again, holding members 46 have been released and locator 34 and barrel 30 are moveable relative to one another.

Figure 4:
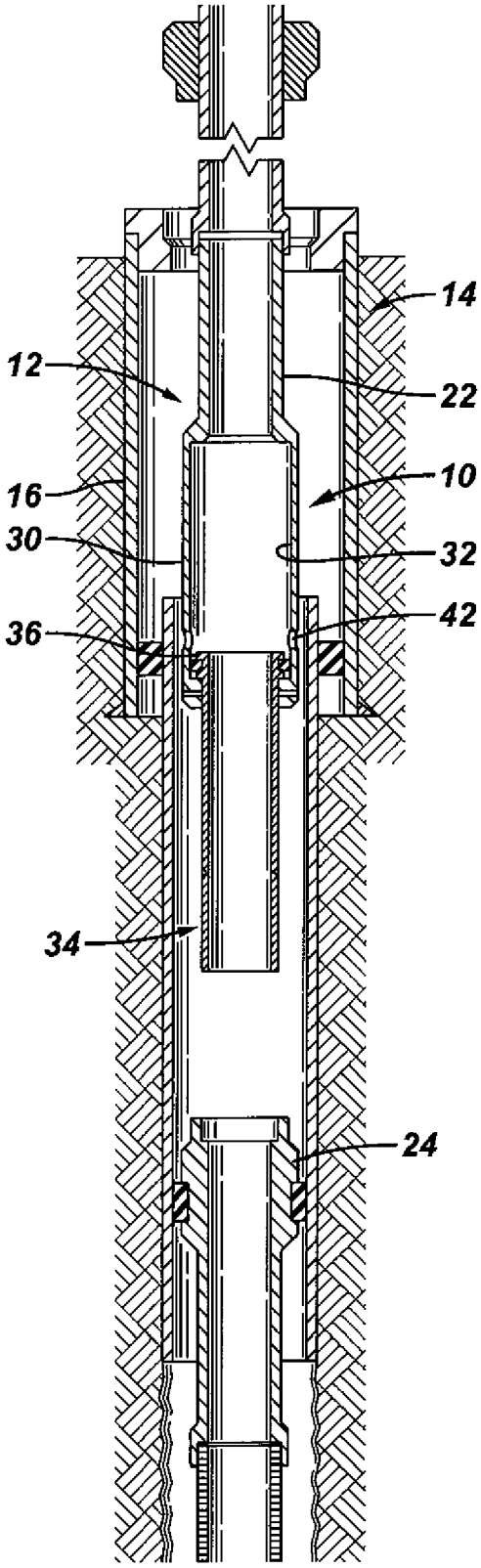
FIG. 4 is a well schematic illustrating the retrieval of tubing and an integral polished bore assembly from the wellbore simultaneously.
Figure 5:
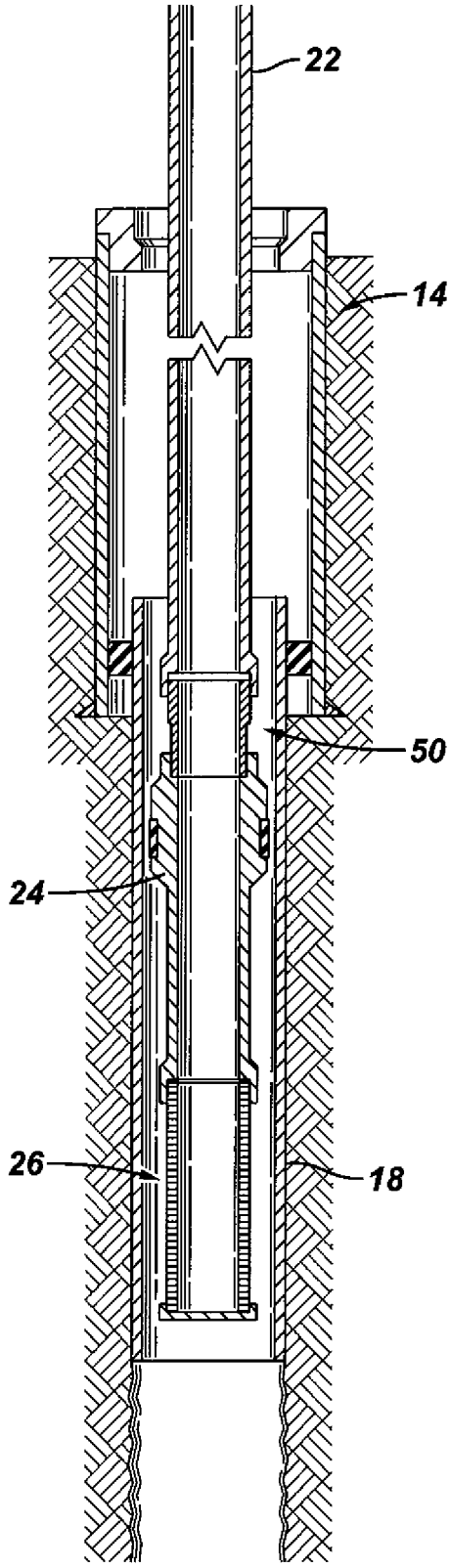
FIG. 5 is a well schematic illustrating the step of retrieving a packer.

Refer now to FIGS. 4 and 5, wherein the completion assembly is being retrieved and well 14 is being de-completed. In FIG. 4, PBR assembly 10 and tubing 22 are retrieved simultaneously in one trip, which is tripping-out of well 14 and thus corresponds to one-half a round trip. As an integral assembly, PBR assembly 10 does not separate and thus facilitates simultaneous removal of assembly 10 and PBR assembly 10. The prior systems commonly include the steps of tripping out with the tubing and commonly a PBR locator that is disconnected from the PBR barrel (1 trip); and then tripping back in with the tubing and a PBR retrieval tool (1 trip), connecting with the PBR barrel, and then tripping out with the PBR barrel and tubing (1 trip) for a total of 3 trips or one and one-half round trips.

FIG. 5 represents a round trip to remove packer 24 and completion 26. After the step of removing PBR assembly 10 (FIG. 4) tubing 22 is tripped into the wellbore with a retrieving tool 50, packer 24 is engaged by tool 50, released from liner 18, and then tubing 22, packer 24, and completion 26 are tripped-out.

Figure 6:
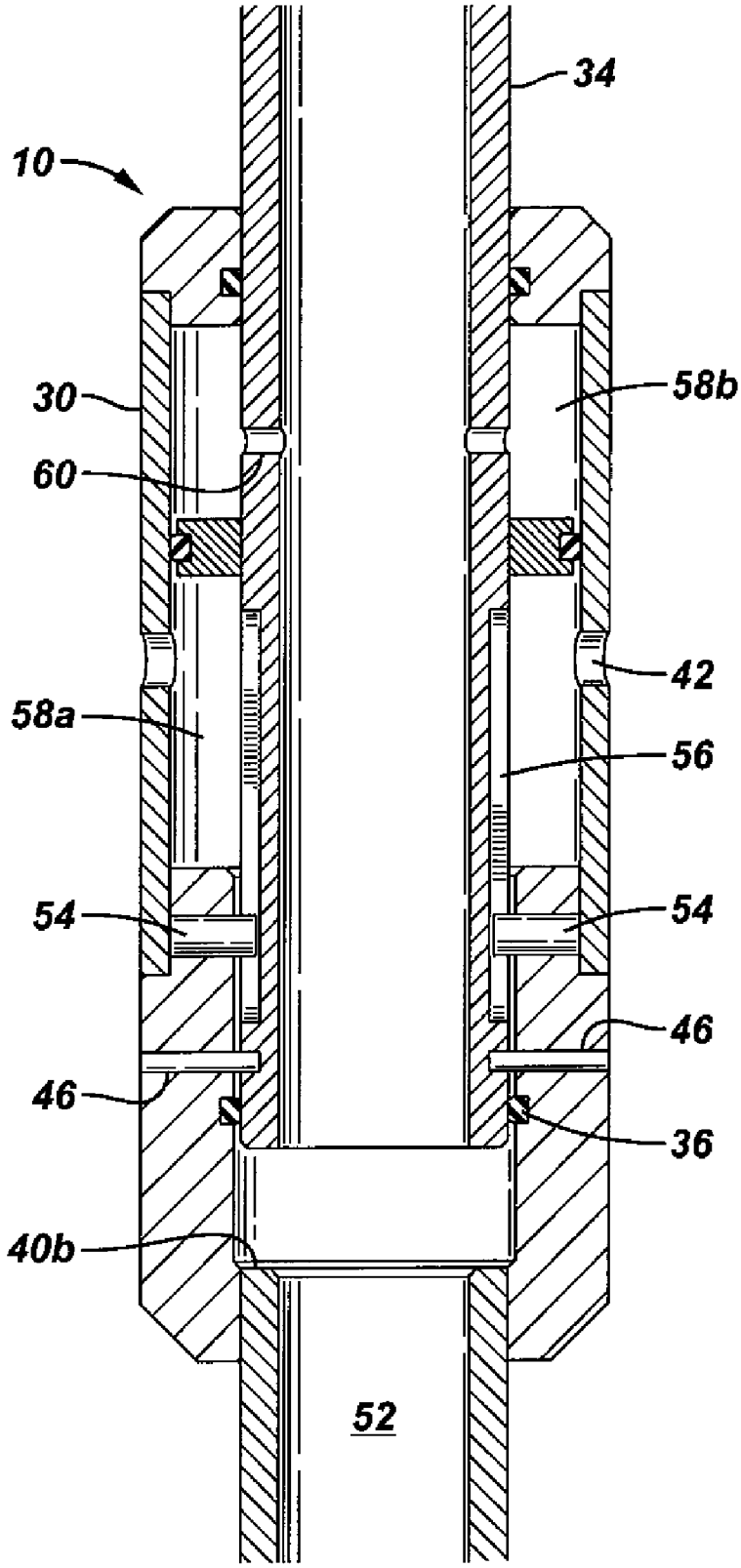
FIG. 6 is a conceptual view of another example of an integral polished bore receptacle assembly.

Refer now to FIG. 6 wherein another embodiment of integral PBR assembly 10 is illustrated. The embodiment of FIG. 6 may be referred to as a volume balanced PBR assembly. Volume balanced PBR assembly 10 facilitates axial movement of locator 34 relative to barrel 30 when the longitudinal bore 52 assembly 10 and the completion assembly is blocked or plugged on both sides of assembly 10. In at least some embodiments, a closed chamber is formed when both ends are plugged. Well bore fluid in the closed chamber may be displaced in order to allow relative axial movement between PBR and locator.

Assembly 10 includes a spline 54 that extends from barrel 30 into internal bore 52 and serves as a no-go. In the illustrated example, seal head 36 is positioned between no-go 40*b* and spline 54. Spline 54 is disposed within open track 56 of locator 34. A first chamber 58*a* is provided between locator 34 and barrel 30 in fluid communication with radial port 42. A second chamber 58*b* is formed between barrel 30 and locator 34. Second chamber 58*b* is in fluid communication with internal bore 52 through a lateral port 60 formed through locator 34. Tension may be applied to locator 34 sufficient to move locator 34 and to provide fluid communication between the annulus, exterior of barrel 30 to internal bore 52 through radial port 42, slot 56, and lateral port 60. As such fluid communication and pressure equalization is facilitated because the volume balanced PBR and locator is designed such that the change in volume between plugs is equal to the change in volume in chamber 58*b*. The fluid volume between plugs is displaced in the chamber 58*b* when the locator is moved axially in relation to PBR. The decrease in volume between plugs is equal to increase in the volume in chamber 58*b*. Hence it is volume balanced. Otherwise the locator can not move axially in the PBR due to fluid trapped in the closed chamber formed between plugs. Volume balanced PBR assembly 10 operates substantially the same as described with reference to FIGS. 1 through 6 with the additional utility of providing for radial pressure equalization if internal bore 52 is plugged, or closed, on both sides of barrel 30 for example.

Although specific embodiments of the invention have been disclosed herein in some detail, this has been done solely for the purposes of describing various features and aspects of the invention, and is not intended to be limiting with respect to the scope of the claims. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An integral polished bore assembly for use in a wellbore, the assembly comprising:

a barrel having a polished bore;

a pair of opposing no-go members positioned within the barrel;

an elongated locator member having a sealing head and an end, the sealing head position between the no-go members and the end extending out of the barrel; and a radial port formed through the barrel between the opposing no-go members wherein fluid flow therethrough is permitted with the sealing head downhole thereof and fluid flow therethrough is blocked with the sealing head uphole thereof.

2. The assembly of claim 1, further including a holding member selectively interconnecting the locator and the barrel to maintain the locator and the barrel in a constant position relative to one another.

3. The assembly of claim 2, wherein when the holding member is interconnecting the locator and the barrel, the radial port is closed to radial fluid flow.

4. The assembly of claim 2, wherein when the holding member is disengaged from interconnecting the locator and the barrel, the locator and the barrel may move relative to one another.

5. The assembly of claim 4, wherein when the locator and the barrel are not interconnected by the holding member, the locator and the barrel move axially, but not rotationally, relative to one another.

6. The assembly of claim 1, further including a holding member selectively interconnecting the locator and the barrel to maintain the locator and the barrel in a constant position relative to one another when interconnected, and wherein radial fluid flow is blocked through the port when the holding member is interconnecting the locator and the barrel.

7. The assembly of claim 6, wherein when the holding member is disengaged from interconnecting the locator and the barrel, the locator and the barrel may move relative to one another.

8. The assembly of claim 1, further including means for equalizing pressure across the radial port.

9. A wellbore system comprising:

a tubular string;

a packer; and an integral polished bore assembly interconnecting the tubular string and the packer, wherein the integral polished bore assembly facilitates removing the tubular string and integral polished bore assembly simultaneously from the wellbore and further comprises a polished bore barrel having a port for bi-directional fluid flow therethrough, the barrel accommodating a pair of opposing no-go members therein disposed at either side of a sealing head of an elongated locator member of the assembly.

10. The system of claim 9, further including a holding member selectively interconnecting the locator and the barrel to maintain the locator and the barrel in a constant position relative to one another when interconnected, and wherein radial fluid flow is blocked through the port when the holding member is interconnecting the locator and the barrel.

11. The assembly of claim 10, wherein when the holding member is disengaged from interconnecting the locator and the barrel, the locator and the barrel may move relative to one another.

12. The assembly of claim 11, wherein when the locator and the barrel are not interconnected by the holding member, the locator and the barrel may move axially, but not rotationally relative to one another.

13. A method of using an integral polished bore assembly in a wellbore, the method comprising the steps of:

interconnecting a tubing string and a packer with an integral polished bore assembly, the assembly having a polished bore barrel with a bi-directional radial port to allow uphole and downhole fluid flow therethrough;

deploying the interconnected tubing string, integral polished bore assembly, and the packer in a wellbore;

disconnecting the integral polished bore assembly from the packer; and retrieving the tubing and the integral polished bore assembly simultaneously from the wellbore.

14. The method of claim 13, wherein the interconnected tubing string, integral polished bore assembly, and packer are deployed simultaneously in the wellbore in a single trip.

15. The method of claim 14, wherein the integral polished bore further comprises:

a pair of opposing no-go members positioned within the barrel and disposed at either side of the radial port; and an elongated locator member having a sealing head and an end, the sealing head position between the no-go members and the end extending out of the barrel.

16. The method of claim 15, wherein the end of the elongated member is connected to the packer.

17. The method of claim 15, further including a holding member selectively interconnecting the locator and the barrel to maintain the locator and the barrel in a constant position relative to one another when interconnected, and wherein radial fluid flow is blocked through the port when the holding member is interconnecting the locator and the barrel.

18. The method of claim 17, wherein when the holding member is disengaged from interconnecting the locator and the barrel, the locator and the barrel may move relative to one another.

19. The method of claim 18, wherein when the locator and the barrel are not interconnected by the holding member, the locator and the barrel may move axially, but not rotationally relative to one another.

* * * * *